US008850630B2

(12) United States Patent
Akbarpour

(10) Patent No.: US 8,850,630 B2
(45) Date of Patent: Oct. 7, 2014

(54) DUAL FLUSH DEVICE

(76) Inventor: Sam Akbarpour, Corona, CA (US)

( * ) Notice: Subject to any disclaimer, the term of this patent is extended or adjusted under 35 U.S.C. 154(b) by 0 days.

(21) Appl. No.: 13/597,074

(22) Filed: Aug. 28, 2012

(65) Prior Publication Data

US 2013/0055497 A1 Mar. 7, 2013

Related U.S. Application Data

(60) Provisional application No. 61/528,666, filed on Aug. 29, 2011, provisional application No. 61/548,077, filed on Oct. 17, 2011.

(51) Int. Cl.
*E03D 5/02* (2006.01)
*E03D 1/30* (2006.01)

(52) U.S. Cl.
CPC . *E03D 1/306* (2013.01); *E03D 5/02* (2013.01)
USPC ..... 4/325

(58) Field of Classification Search
CPC ..... E03D 1/144
USPC ..... 4/300, 325–326, 353, 443
See application file for complete search history.

(56) References Cited

U.S. PATENT DOCUMENTS

| | | | | |
|---|---|---|---|---|
| 4,080,668 | A | 3/1978 | Banes | |
| 4,864,665 | A * | 9/1989 | Toltzman | 4/325 |
| 5,333,331 | A * | 8/1994 | Battle | 4/324 |
| 5,396,666 | A | 3/1995 | Tsai et al. | |
| 5,428,848 | A * | 7/1995 | Battle | 324/324 |
| 6,742,194 | B2 * | 6/2004 | Shim | 4/325 |
| 2004/0040077 | A1 * | 3/2004 | Shim | 4/325 |
| 2011/0197974 | A1 * | 8/2011 | Menear et al. | 137/192 |

FOREIGN PATENT DOCUMENTS

JP 07324362 12/1995

* cited by examiner

*Primary Examiner* — Lori Baker
(74) *Attorney, Agent, or Firm* — K. David Crockett, Esq.; Paul J. Backofen, Esq.; Crockett & Crockett, PC

(57) ABSTRACT

The devices and methods described, provide for a dual flush device with a handle sleeve with a rotation stop and a lift arm extending through the handle sleeve with a rotation limiting tab on the lift arm to engage the rotation stop to enable the lift arm to rotate in a first direction through a first arc and to rotate in a second direction through a second arc where the first arc is smaller than the second arc. A dual flush device with a lift arm added to conventional toilet will enable the toilet to perform two different flush actions, a small partial flush for liquid waste, and a second, full flush for solid waste.

5 Claims, 5 Drawing Sheets

DUAL FLUSH DEVICE

RELATED APPLICATIONS

This application claims priority from U.S. Provisional Patent Application 61/528,666 filed Aug. 29, 2011 and from U.S. Provisional Patent Application 61/548,077 filed Oct. 17, 2011.

FIELD OF THE INVENTIONS

The inventions described below relate to the field of sanitation and more specifically to sanitary flush toilets.

BACKGROUND OF THE INVENTIONS

Conservation of fresh water is a worldwide concern. In developed countries a large portion of fresh water usage is used merely to flush toilets. Conventional dual flush toilets address this problem, but are expensive and generally require replacement of the flush mechanism in a toilet.

SUMMARY

The devices and methods described below provide for a dual flush toilet operable to perform two different flush actions; a small partial flush for liquid waste, and a second, full flush for solid waste. A new toilet or a conventional toilet are modified with the addition of a handle sleeve with a rotation stop and a lift arm extending through the handle sleeve with a rotation limiting tab on the lift arm to engage the rotation stop to enable the lift arm to rotate in a first direction through a first arc and to rotate in a second direction through a second arc where the first arc is smaller than the second arc.

A lift line extending from the offset distal end of the lift arm connects to the flapper or ball valve of the toilet. When the lift arm rotates through the first arc the flapper is raised to a first position resulting in a small partial flush for clearing liquid waste, and when the lift arm rotates through the second arc the flapper is raised to a second position resulting in a full flush for clearing solid waste.

DETAILED DESCRIPTION OF THE INVENTIONS

Figure 1:
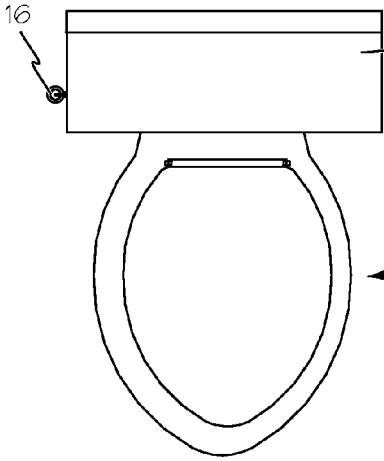
FIG. 1 is a top view of a dual flush toilet.
Figure 3:
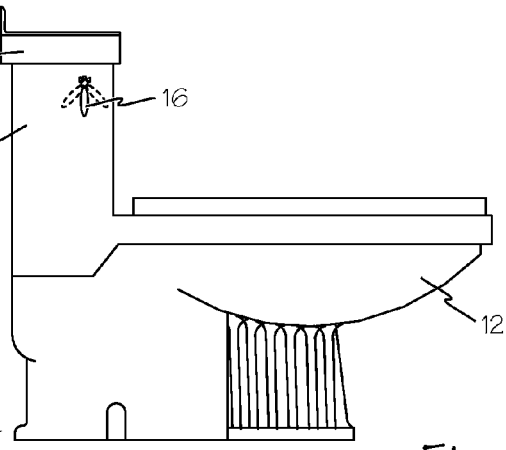
FIG. 3 is a side view of the dual flush toilet of FIG. 1.
Figure 2:
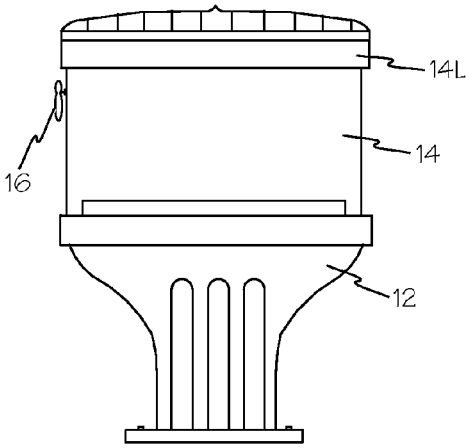
FIG. 2 is a front view of the dual flush toilet of FIG. 1.

Dual Flush Toilet 10 of FIGS. 1, 2 and 3 includes bowl 12 and tank 14 with side mounted lift arm assembly 15 and handle 16. Tank 14 is enclosed and covered by tank lid 14L.

Figure 4:
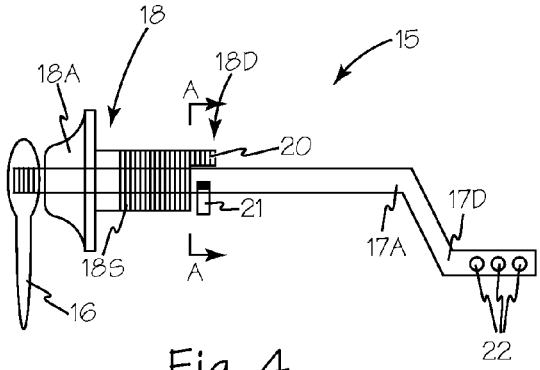
FIG. 4 is a side view of a dual flush lift arm and handle assembly.
Figure 5:
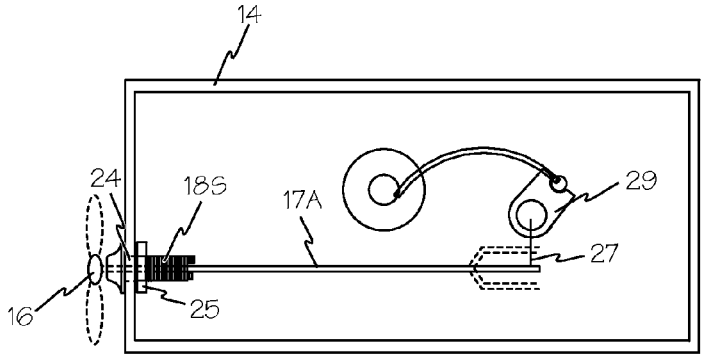
FIG. 5 is a top view of a toilet tank including the dual flush lift arm and handle assembly of FIG. 4, with the tank lid removed.

Referring now to FIGS. 4 and 5, lift arm assembly 15 includes handle 16 secured to lift arm 17 which extends through handle sleeve 18. Handle sleeve 18 includes a generally decorative flange 18A secured to threaded sleeve 18S. Distal end 18D of threaded sleeve 18S includes rotation stop 20. Lift arm 17 has a generally straight main shaft 17A and offset distal end 17D. Main shaft 17A includes rotation limiting tab 21. Offset distal end 17D includes one or more attachment holes such as holes 22.

In use, lift arm assembly 15 is secured through an opening in a toilet tank such as hole 24 in tank 14S using a lock nut 25 engaging threaded sleeve 18S. Lift line 27 is secured between one of the attachment holes 22 and the flapper or ball valve 29. Rotation of handle 16 in either a clockwise or counterclockwise direction causes offset distal end 17D to rotate in a corresponding direction and pull lift line 27 which lifts flapper or ball valve 29 allowing water from the tank to flush the toilet. In a side handle tank such as tank 14S, lift arm 17 is sized to orient distal offset end 17D vertically above flapper valve 29 as shown.

Figure 6A:
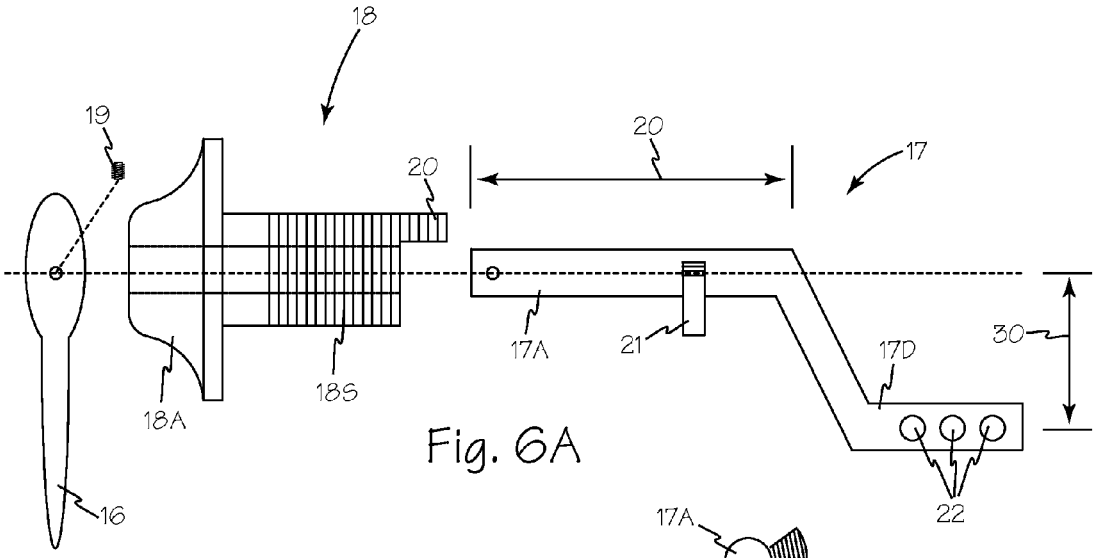
FIG. 6A is an exploded view of the dual flush lift arm and handle assembly of FIG. 4.
Figure 6B:
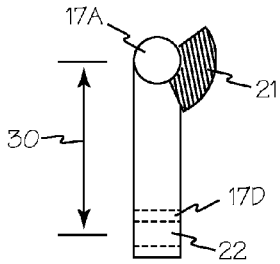
FIG. 6B is an end view from the handle end of the lift arm of FIG. 6A.

Referring now to FIGS. 6A and 6B, lift arm 17 has a generally cylindrical main shaft 17A and an offset distal end 17D. Offset length 30 and the size and orientation of rotation limiting tab 21 determine which direction of handle rotation results in a partial flush and which direction of handle rotation results in a full flush. Length 32 of main shaft 17A may be adjustable to enable a single lift arm assembly to operate in a side handle or front handle toilet. Main shaft 17A may telescope between rotation limiting tab 21 and first offset bend 17B. Handle 16 may be attached to main shaft 17A using any suitable attachment such as threads as shown in FIG. 4 or an inset locking bolt or screw such as hex screw 19 through handle 16 into contact with main shaft 17A.

Figure 7:
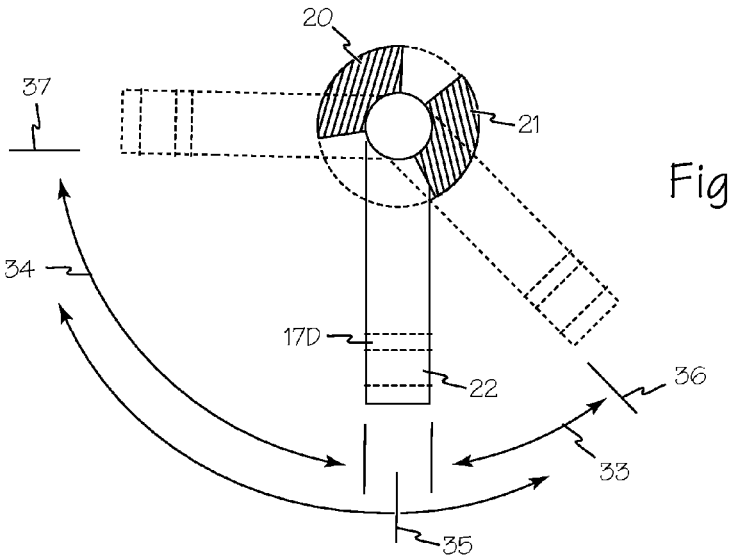
FIG. 7 is an cross section view of the dual flush lift arm and handle assembly of FIG. 4 taken along A-A.

Referring now to FIG. 7, rotation limiting tab 21 is secured to the main shaft of the lift arm to contact rotation stop 20 during counterclockwise rotation after rotating through a first, small arc 33, and to contact rotation stop 20 during clockwise rotation after rotating through second arc 34 which is larger than the first arc. The orientation of rotation stop 20 and rotation limiting tab 21 may be reversed to achieve the same result. Handle 16 is generally aligned with offset distal end 17D, and the normal rest position of both the handle and the offset distal end is at normal or rest position 35. To achieve a partial flush, handle 16 is rotated through arc 33 until rotation limiting tab 21 contacts rotation stop 20 at position 36. Rotation of the lift arm causes offset distal end 17D to rotate through the same arc, arc 33. To achieve a full flush, handle 16 is rotated through arc 34 until rotation limiting tab 21 contacts rotation stop 20 at full flush position 37. Rotation of the lift arm causes offset distal end 17D to rotate through the same arc, arc 34.

Figure 8:
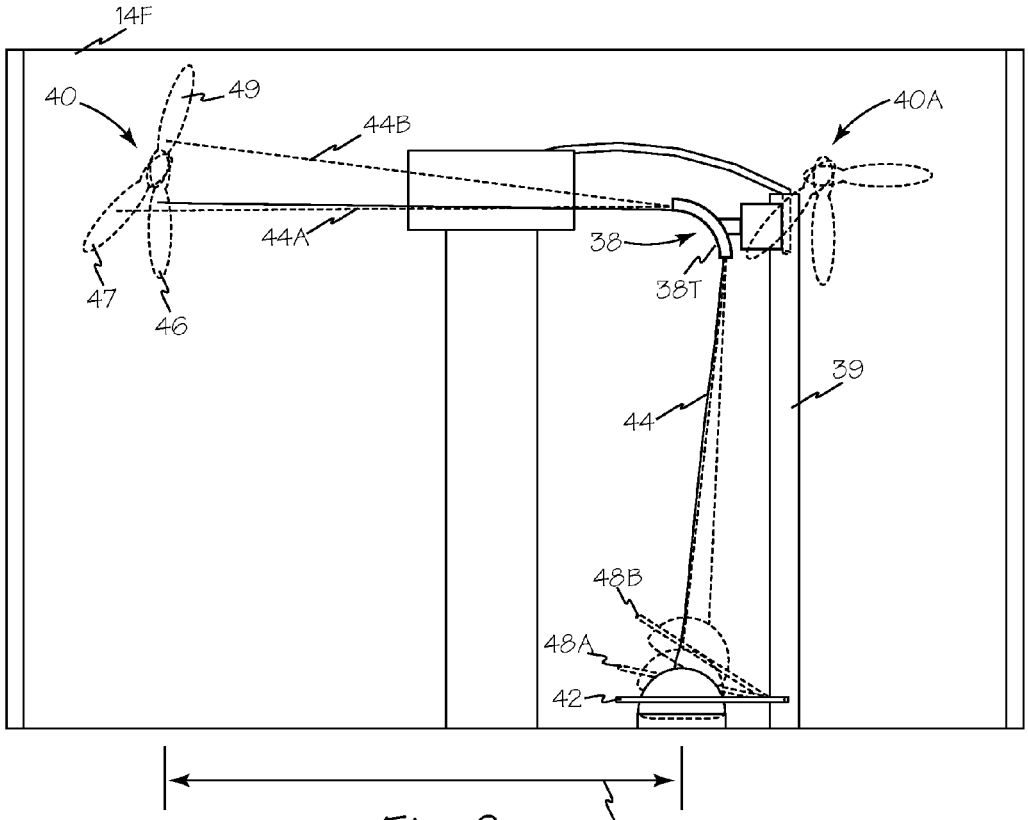
FIG. 8 is a front view of a toilet tank with a front mounted dual flush lift arm.
Figure 9:
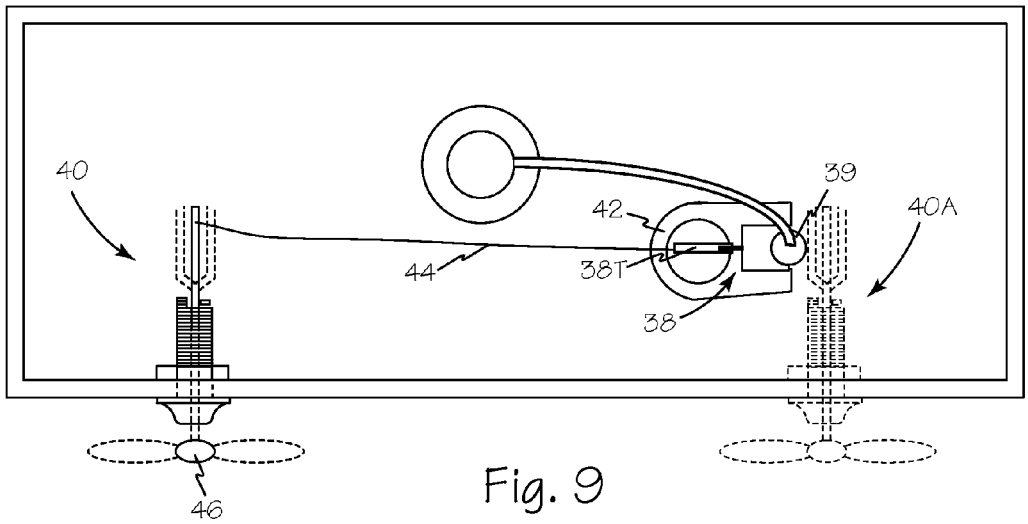
FIG. 9 is a top view of the toilet tank of FIG. 8 with the tank lid removed.

Tank 14F of FIGS. 8 and 9 is configured for a flush handle mounted on the front of the tank. In a retrofit situation, when handle assembly 40 is generally located at a horizontal distance 41 from flapper valve 42. As handle offset distance 41 grows, the efficiency of dual flush handle assembly 40 diminishes. For tank configurations with excessive handle offset distances, a force redirection assembly such as assembly 38 may be secured to tube 39. Assembly 38 enables lift line 44 to apply the force from movement of the handle to be applied vertically or near vertically to flapper valve 42. Any suitable means for securing the force redirection assembly to the tube may be used, such as adhesives, straps, clips and removable fasteners such as screws or pop rivets. Alternatively, dual flush efficiency may be improved by locating front mounted handle assembly 40A vertically over flapper valve 42 as shown.

In use, front mounted lift arm assembly 40 is secured toilet tank 14F as discussed above. Lift line 44 is secured to one of the attachment holes 22 and extends through lift line channel or tube 38T of the force redirection assembly and to the flapper or ball valve 42. Rotation of handle 46 through the first small arc to position 47 causes offset distal end 17D to rotate in a corresponding direction and pull lift line 44 into position 44A which lifts flapper or ball valve 42 into first valve position 48A allowing water from the tank to partially flush the toilet such as to clear liquid waste. Rotation of handle 46 through the second larger arc to position 49 causes offset distal end 17D to rotate in a corresponding direction and pull lift line 44 into position 44B which lifts flapper or ball valve 42 into second valve position 48B allowing water from the tank to fully flush the toilet such as to clear solid waste. The length of lift line 44 also operates to limit the rotation of the lift arm and correspondingly handle 46 when performing a full flush.

Figure 10:
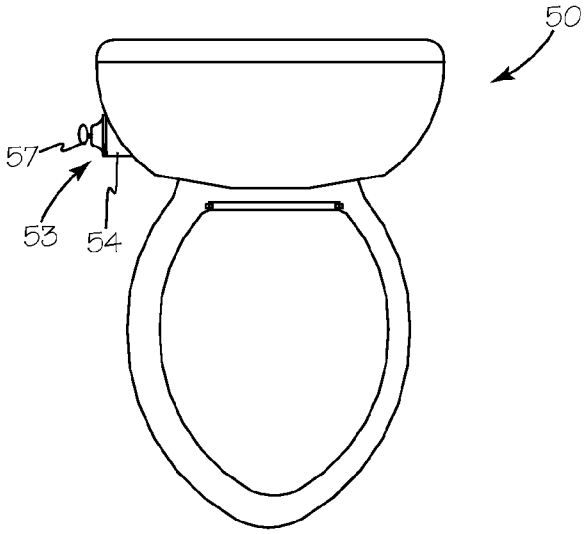
FIG. 10 is a top view of a dual flush toilet with a rounded tank.
Figure 11:
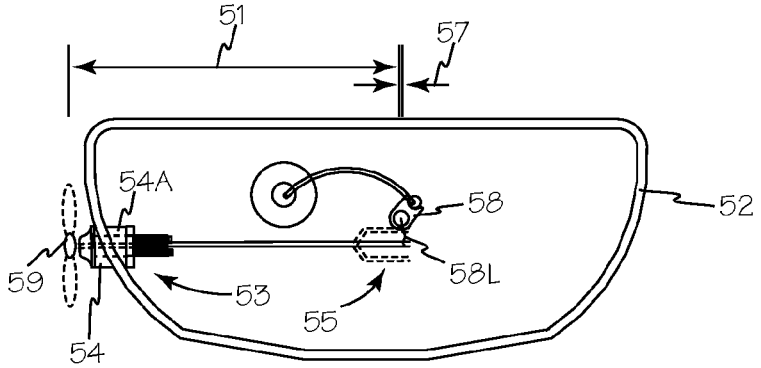
FIG. 11 is a top view of the tank of the FIG. 10 with the tank lid removed.

Referring now to FIGS. 10 and 11, dual flush toilet 50 has a rounded tank 52 equipped with offset lift arm assembly 53 as discussed above. The curvature of tank 52 may necessitate the use of a tapered shim such as shim 54 to control the orientation of lift arm assembly 53 and minimize the effect of an excessive handle offset distance 51. The tapered shims 54 and 54A permit offset distal end 55 to be oriented above flapper valve 56 with minimal horizontal offset 57 between flapper valve 58 and offset distal end 55 of the lift arm. As discussed above, rotation of handle 59 clockwise through first small arc causes offset distal end 55 to rotate in a corresponding direction and pull lift line 58L which lifts flapper or ball valve 58 into the first valve position allowing water from the tank to partially flush the toilet such as to clear liquid waste. Rotation of handle 59 counterclockwise through the second larger arc causes offset distal end 55 to rotate in a corresponding direction and pull lift line 58L which lifts flapper or ball valve 58 into the second valve position allowing water from the tank to fully flush the toilet such as to clear solid waste. Any other suitable orientation of a rotation limiting tab and a rotation stop to generate a first small arc for a partial flush and a second larger arc to generate a full flush may be used. Alternatively, a force redirection assembly as shown in FIGS. 8 and 9 may also be used.

Figure 12:
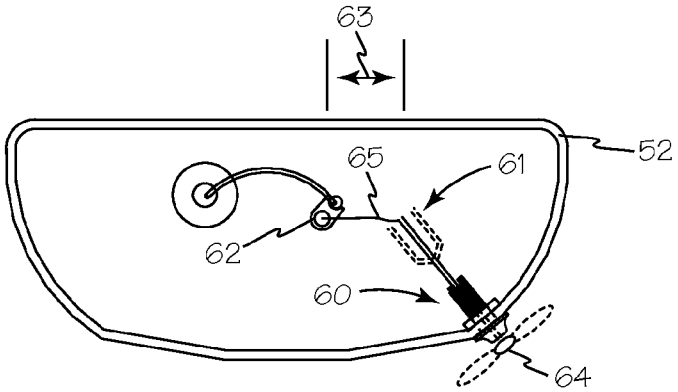
FIG. 12 is a top view of the tank of the FIG. 10 with the tank lid removed to show an alternate handle arrangement.

Referring now to FIG. 12, for new toilets, mounting offset lift arm assembly 60 on the right side of the tank as viewed from the bowl side of the toilet permits offset distal end 61 to be oriented above flapper valve 62 with minimal horizontal offset 63 between flapper valve 62 and offset distal end 61 of the lift arm. As discussed above, rotation of handle 64 clockwise through first small arc causes offset distal end 61 to rotate in a corresponding direction and pull lift line 65 which lifts flapper or ball valve 62 into the first valve position allowing water from the tank to partially flush the toilet such as to clear liquid waste. Rotation of handle 64 counterclockwise through the second larger arc causes offset distal end 61 to rotate in a corresponding direction and pull lift line 65 which lifts flapper or ball valve 62 into the second valve position allowing water from the tank to fully flush the toilet such as to clear solid waste. Any other suitable orientation of a rotation limiting tab and a rotation stop to generate a first small arc for a partial flush and a second larger arc to generate a full flush may be used.

Figure 13:
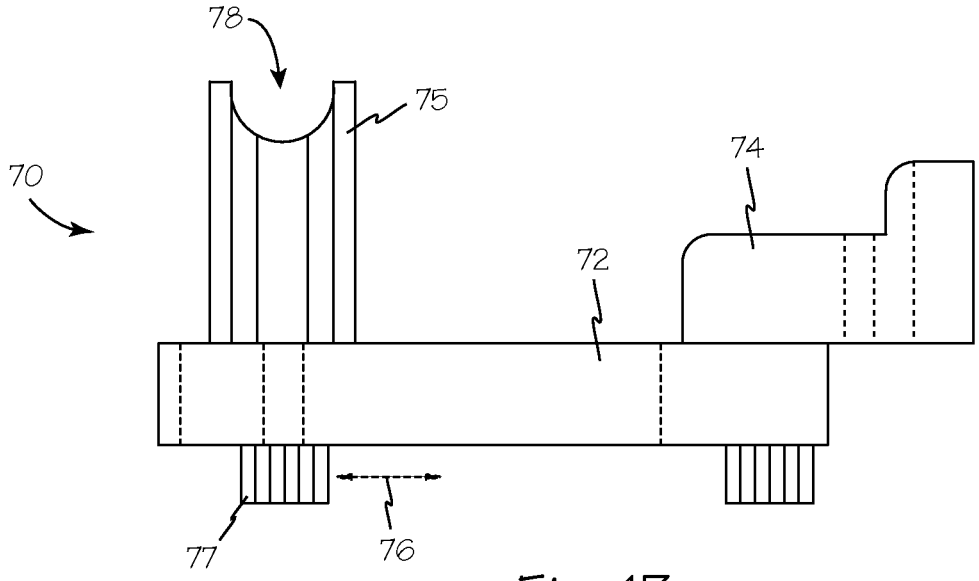
FIG. 13 is a side view of a force redirection assembly.
Figure 14:
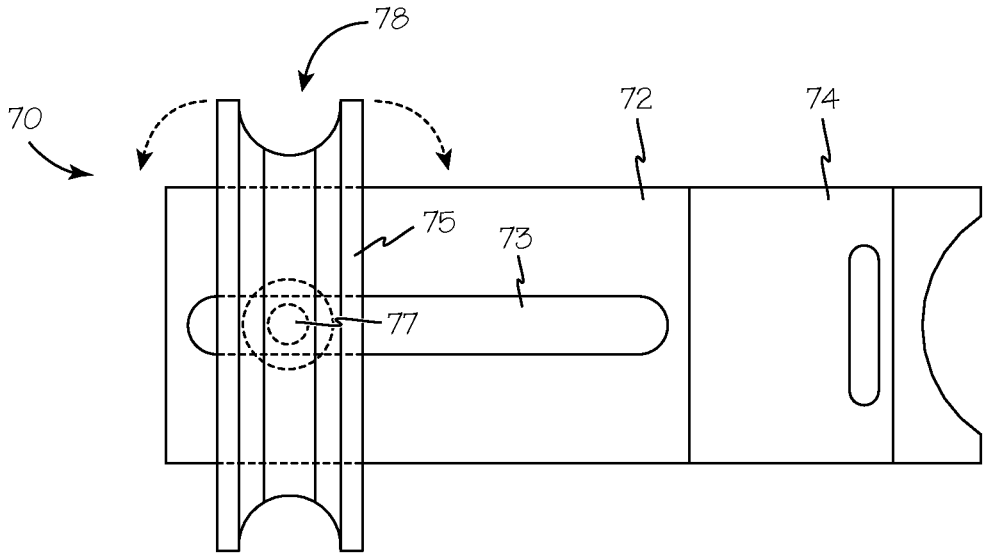
FIG. 14 is a top view of the force redirection assembly of FIG. 13.

Force redirection assembly 70 of FIGS. 13 and 14 is used when the handle offset distance 41 prevents efficient functioning of a dual flush device as occurs in retrofit situations as discussed with respect to FIGS. 8 and 9. Assembly 70 is secured to the fill tube in the toilet tank. Assembly 70 enables the lift line to apply the force from the handle to be applied vertically or near vertically to the flapper valve. Assembly body 72 includes slot 73 and is secured to a fill tube using attachment bracket 74. Slot 73 permits cam 75 to be adjustably attached to body 72 with the ability to translate cam 75 along body axis 76. Cam 75 may also be rotated about attachment bolt 77. Cam 75 includes channel 78 to control and direct the lift line.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

I claim:

1. A dual flush device comprising:

a handle sleeve having a flange on a first end and a rotation stop on a second end;

a lift arm having a main shaft extending through the handle sleeve and an offset distal end;

a rotation limiting tab secured to the main shaft for contacting the rotation stop to enable the lift arm to rotate in a first direction through a first arc and to rotate in a second direction through a second arc where the first arc is smaller than the second arc.

2. The dual flush device of claim 1 further comprising:

a lift line extending from the offset distal end of the lift arm to a flapper wherein when the lift arm rotates through the first arc the flapper is raised to a first position and when the lift arm rotates through the second arc the flapper is raised to a second position where the second position is equivalent to a full flush.

3. The dual flush device of claim 2 further comprising:

a force redirection assembly adapted to be secured to a toilet fill tube, the force redirection assembly including a lift line channel for redirecting the lift line between the lift arm and the flapper.

4. A dual flush toilet comprising:

a toilet tank with a handle hole through a wall of the tank;

a handle sleeve extending through the handle hole, the sleeve having a flange on a first end and a rotation stop on a second end;

a lift arm having a main shaft extending through the handle sleeve and an offset distal end;

a rotation limiting tab secured to the main shaft for contacting the rotation stop to enable the lift arm to rotate in a first direction through a first arc and to rotate in a second direction through a second arc where the first arc is smaller than the second arc;

a lift line extending from the offset distal end of the lift arm to a flapper wherein when the lift arm rotates through the first arc the flapper is raised to a first position and when the lift arm rotates through the second arc the flapper is raised to a second position where the second position is equivalent to a full flush.

5. The dual flush device of claim 4 further comprising:

a force redirection assembly adapted to be secured to a toilet fill tube, the force redirection assembly including a lift line channel for redirecting the lift line between the lift arm and the flapper.

* * * * *